United States Patent [19]

Spamer

[11] 4,314,648

[45] Feb. 9, 1982

[54] GRAVITY FEED SHELF

[75] Inventor: William S. Spamer, Roswell, Ga.

[73] Assignee: The Mead Corporation, Dayton, Ohio

[21] Appl. No.: 98,876

[22] Filed: Nov. 30, 1979

[51] Int. Cl.[3] ..... A47F 1/00

[52] U.S. Cl. ..... 211/49 D; 193/2 R; 211/135

[58] Field of Search ..... 211/49 D, 135, 134, 211/153; 108/108; 193/2 R, 38, 41

[56] References Cited

U.S. PATENT DOCUMENTS

| | | | |
|---|---|---|---|
| 1,758,098 | 5/1930 | Williams | 211/49 D |
| 2,218,444 | 10/1940 | Vineyard | 211/49 D |
| 2,649,207 | 8/1953 | Shield | 211/49 D |
| 3,318,455 | 5/1967 | Takahashi | 211/49 D |
| 3,556,306 | 1/1971 | Shell | 108/108 X |

FOREIGN PATENT DOCUMENTS

| | | | |
|---|---|---|---|
| 43097 | 10/1970 | Finland | 211/49 D |

*Primary Examiner*—Roy D. Frazier
*Assistant Examiner*—Robert W. Gibson, Jr.
*Attorney, Agent, or Firm*—Rodgers & Rodgers

[57] ABSTRACT

A gravity feed shelf for use as a component of a display device for primary packages such as bottled soft drinks in retail outlets includes a substantially rigid support frame which is forwardly and downwardly inclined and which includes front and rear support surfaces and an intermediate support surface therebetween, the support surfaces being disposed in an imaginary downwardly and forwardly inclined straight line and with elongated channel shaped chutes of extruded plastic material mounted in downwardly inclined side-by-side relation on the frame so that rows of articles such as bottles may be mounted in each chute whereby removal of the front bottle in a chute allows the remaining bottles to slide downwardly so as to render the bottles more readily accessible at the front of the shelf. When unloaded each plastic chute is bowed upwardly and when loaded the chute is straightened so that its ends are disposed in contact with the front and rear support surfaces of the support frame and so that its intermediate portion is in contact with the intermediate support surface. This feature results in spring-like action when the front bottle in a row is removed whereby a slight upward movement of the chute occurs due to removal of the front bottle which results in jostling of the remaining bottles so that any friction which would tend to inhibit the downward and forward movement of the bottles is overcome by the jostling action of the chute.

14 Claims, 8 Drawing Figures

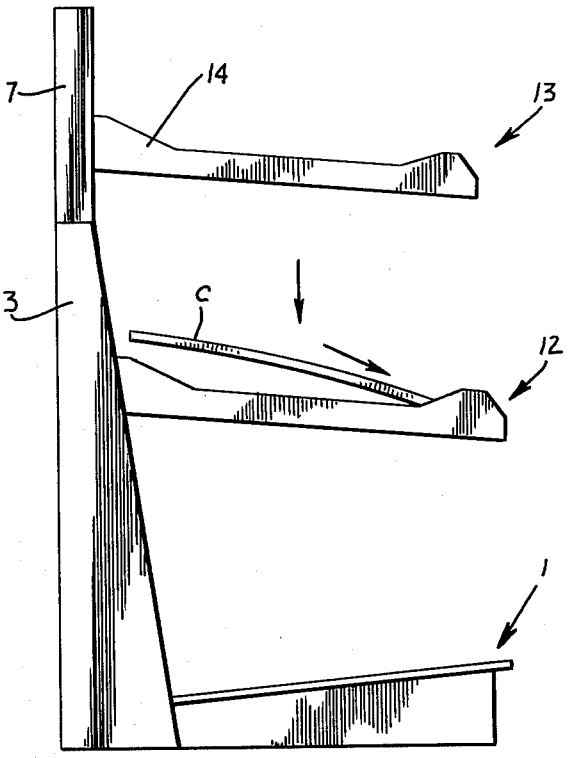
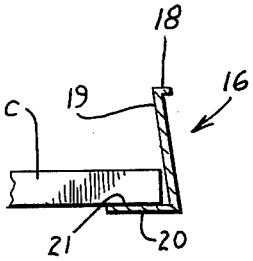
Fig. 3A
Fig. 2
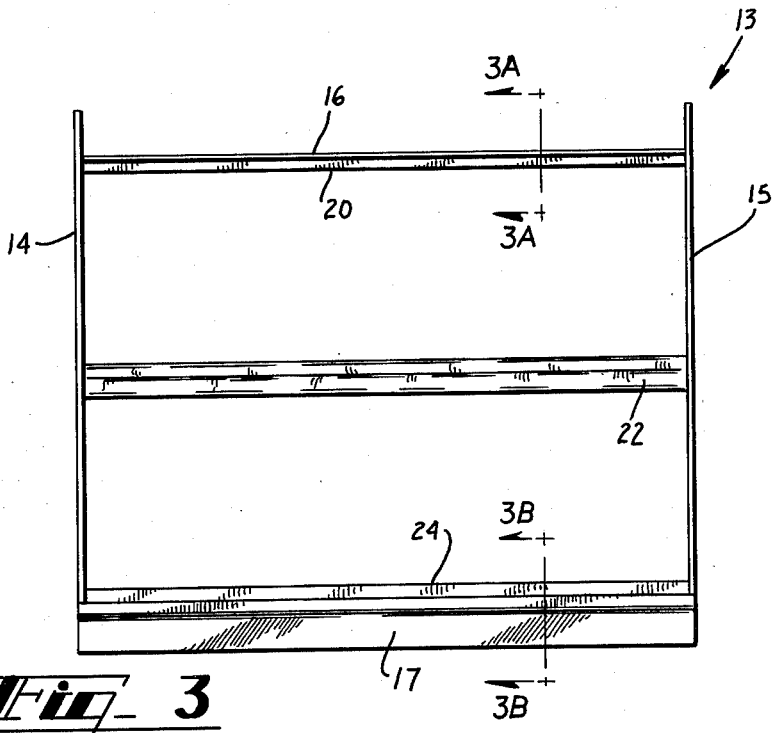
Fig. 3

GRAVITY FEED SHELF

TECHNICAL FIELD

This invention relates to gravity feed shelves which are characterized by low friction, simplicity of construction and a high degree of economy in both initial and maintenance costs.

BACKGROUND ART

One type of gravity feed shelf includes a downwardly tilted planar support surface over which a feeder belt is arranged to slide. Such a gravity feed display shelf is disclosed and claimed in U.S. Pat. No. 4,128,177 issued Dec. 5, 1978. Since each shelf ordinarily includes a plurality of belts and their supporting structures, a display rack according to U.S. Pat. No. 4,128,177 is complicated in construction and is expensive to build and maintain.

Another example of a gravity feed device is represented by U.S. Pat. No. 2,218,444 issued Oct. 15, 1940 which discloses a metal channel intended primarily for use in conjunction with milk bottles in refrigerators. This patent discloses alternative procedures for achieving the desired degree of tilt of the chute. The chute of U.S. Pat. No. 2,218,444 is constructed of metal and does not lend itself well for economical production procedures.

DISCLOSURE OF THE INVENTION

A gravity feed shelf constructed according to this invention must be adapted for use in conjunction with various multiple bottle packs and single bottles formed of plastic or glass and which may utilize different bottom configurations such as the so-called petaloid bottle having six downwardly projecting feet or other bottles in which a central annular recess is formed in the bottom. Thus the invention must provide stability for bottles and packages having different configurations and must be adapted to accommodate downward feeding movement of the bottles with a minimum degree of frictional resistance.

According to this invention in one form, a shelf is provided and comprises a substantially rigid support frame which is forwardly and downwardly inclined and which is provided with front and rear support surfaces together with an intermediate support surface arranged so as to coincide with an imaginary straight line interconnecting the front and rear support surfaces so that a channel shaped upwardly bowed chute formed of extruded plastic material and mounted with its ends in contact with the front and rear support surfaces is spaced somewhat above the intermediate support surface when unloaded. When loaded with packages or single bottles, the plastic chute is straightened and may engage the intermediate support surface so that when the front package or bottle is removed slight upward movement of the chute occurs due to its inherent springiness whereby the remaining packages or bottles are jostled and downward sliding movement thereof toward the front of the shelf is initiated.

BRIEF DESCRIPTION OF DRAWINGS

FIG. 2 is an end view of the display stand shown in FIG. 1;

FIG. 3 is a top plan view of a gravity feed shelf formed according to the invention and without the chutes disposed thereon;

FIG. 3A is a detailed cross-sectional view taken on the line 3A—3A in FIG. 3;

BEST MODE OF CARRYING OUT THE INVENTION

Figure 1:
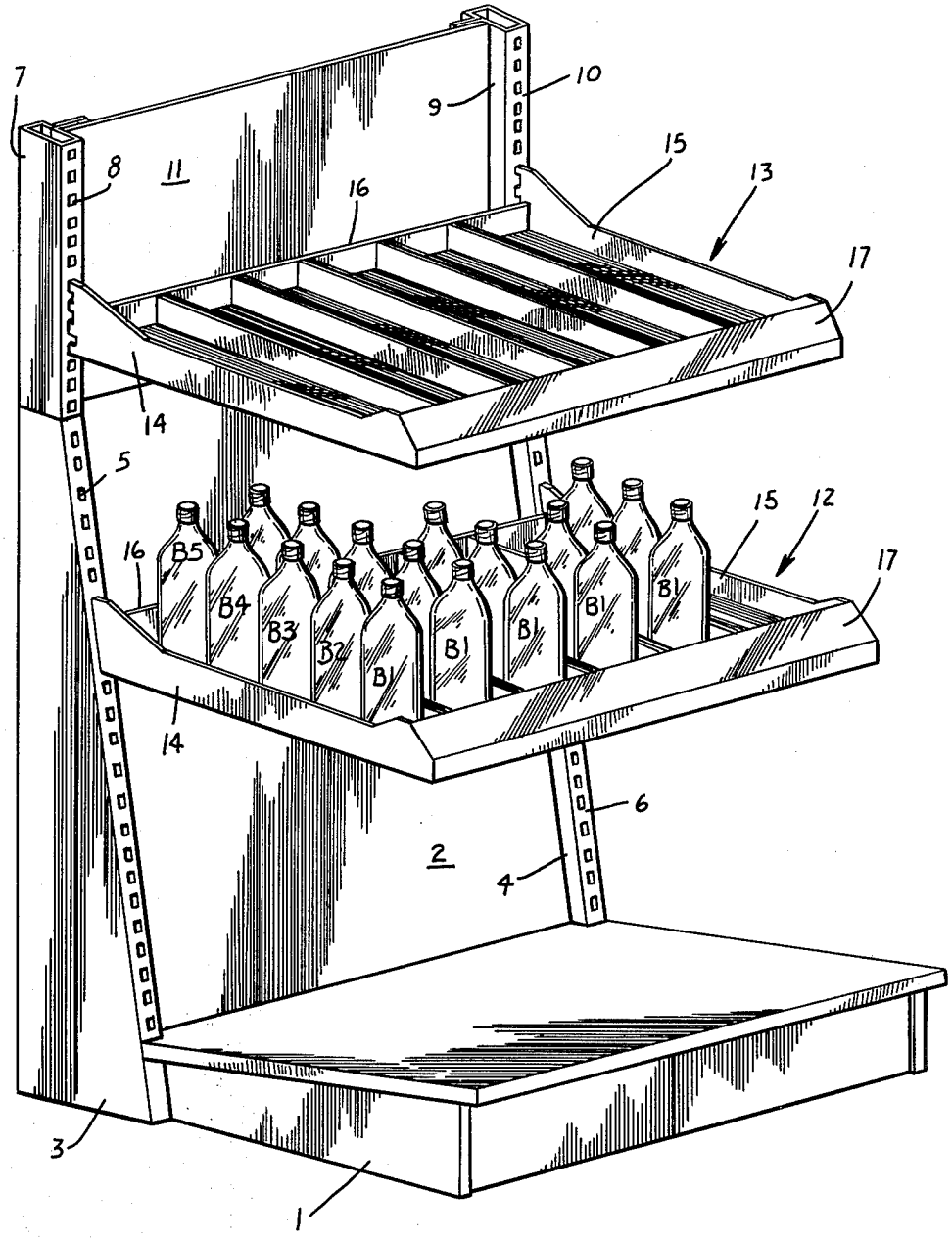
FIG. 1 is a perspective view of a display stand having gravity feed shelves constructed in accordance with one form of the invention.

FIG. 1 shows a soft drink display stand comprising a base 1 and a back panel 2 extending upwardly from the base. Back panel 2 is supported by upright shelf support members 3 and 4 having slotted sloping surfaces 5 and 6 respectively. Secured atop support element 3 is a vertically disposed support element 7 having a vertically disposed slotted support face 8. Similarly a vertically disposed support 9 is mounted atop support element 4 and is provided with a slotted vertical face 10. Back panel 11 is supported by supports 7 and 9. Shelves generally indicated at 12 and 13 are mounted respectively on inclined slotted faces 5 and 6 and on vertically disposed slotted faces 8 and 10.

The shelves 12 and 13 are substantially identical and are supported in substantially parallel relationship to each other on the respective sloping and vertical support faces. Tabs on the shelves cooperate with slots on the sloping and vertical faces in different ways. Thus the shelves are maintained in parallel relationship by virtue of the fact that the tab structure and the angle of the sloping faces of the support members cooperate in such manner as to achieve this result. The manner in which this is accomplished is explained in U.S. Pat. No. 3,983,822 issued Oct. 5, 1976.

Figure 5:
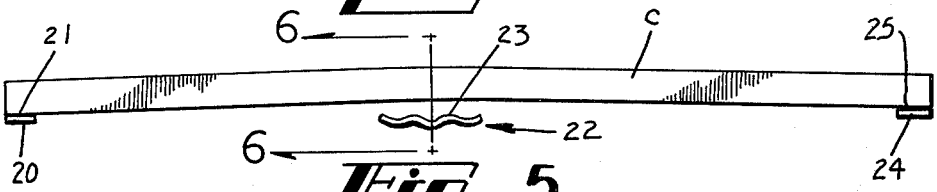
FIG. 5 is a side view of the chute shown in FIG. 4.
Figure 3B:
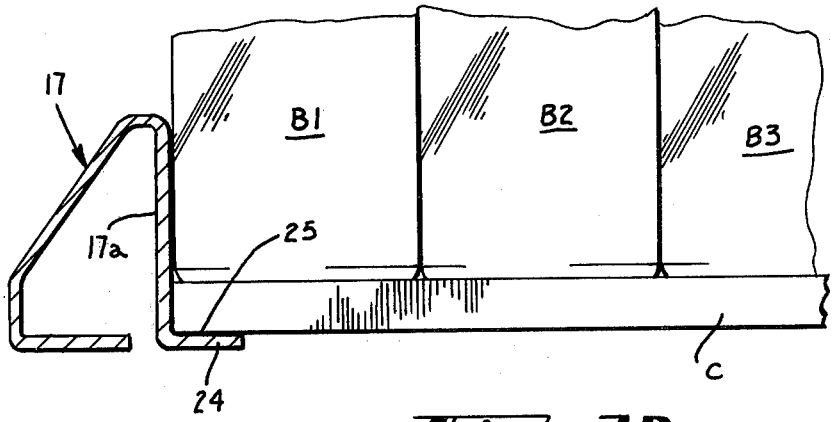
FIG. 3B is a detailed cross-sectional view taken on the line designated 3B—3B in FIG. 3.

As shown in the drawings, each of the shelves such as 12 and 13 comprises a substantially rigid frame structure on which a plurality of channel shaped chutes are mounted. As is best shown in FIG. 3 the shelf such as 13 includes side struts 14 and 15, a rear strut 16 and a forward strut 17. As is best shown in FIG. 3A rear strut 16 includes a top strip 18, a main strip 19 and a bottom strip 20. The top surface of bottom strip 20 is indicated by the numeral 21 and constitutes the rear support surface for one or more chutes mounted on the shelf support frame. An intermediate support element 22 is interconnected at its ends with side struts 14 and 15. As is best shown in FIG. 5, intermediate support element 22 is provided with an intermediate support surface 23 which is spaced somewhat from the lowermost surface of chute C. As is best shown in FIG. 3B the lower strut 17 is provided with an inwardly projecting ledge 24 the top surface 25 of which constitutes a front support surface for the chute C. If desired, the chute may be fastened at this point mechanically or with adhesive.

As is apparent from FIGS. 1 and 2, the shelves 12 and 13 are downwardly and forwardly inclined. Thus there is a natural tendency for a row of bottles to slide downwardly and forwardly so that the lowermost bottles such as B1 normally rest against the vertically disposed portion 17*a* of lower support strut 17.

Figure 4:
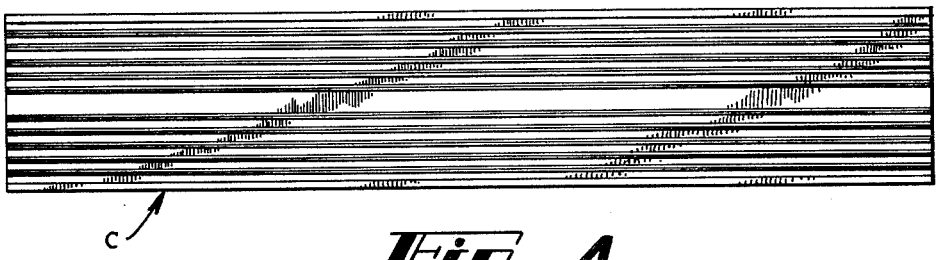
FIG. 4 is a top plan view of an extruded channel shaped chute formed of plastic material and which constitutes an essential element of the shelf shown in FIGS. 1 and 2.
Figure 6:
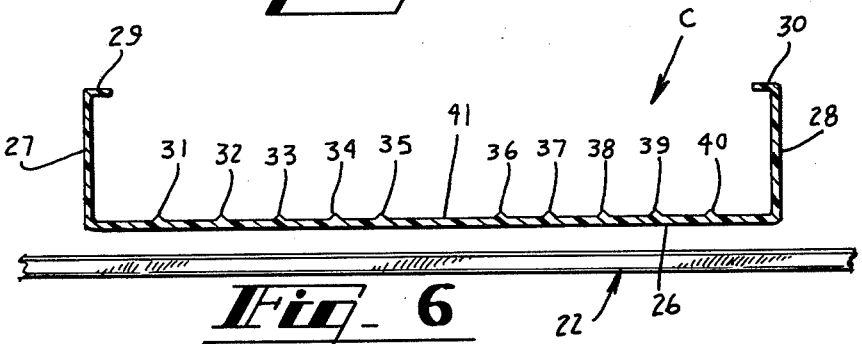
FIG. 6 is a cross-sectional view taken along the line designated 6—6 in FIG. 5.

As is apparent from FIGS. 4, 5 and 6, a chute C includes a central web panel 26 and a pair of side flange panels 27 and 28 which are integrally formed with the web panel 26. Inwardly projecting guide strips 29 and 30 are formed integrally with flange panels 27 and 28 as is apparent in FIG. 6.

For the purpose of minimizing friction between the bottoms of the bottles and the upper surface of web panel 26, a plurality of upwardly projecting ribs 31–40 are provided and are of generally triangular cross-sectional configuration.

As a means of disposing of undesired moisture and debris accumulation a central trough designated by the numeral 41 is formed in the upper surface of web panel 26 and is disposed between the ribs 35 and 36. This trough can serve as a retention cavity for suitable retractable spring means (not shown) which, if desired, could be employed to afford an additional force urging a row of bottles forwardly and downwardly.

Experience has shown that the chutes C may constitute extrusions and may be formed of polyvinyl chloride or if desired may be formed of high impact polystyrene material. Also in order to provide a means of reducing the friction between the ribs 31–40 and the bottoms of bottles disposed thereon, polystyrene may be impregnated with silicone during the manufacturing process so that even though the upper surfaces of the ribs 31–40 may wear, the lubricating action of silicone is always effective because the structure is substantially homogeneous.

The angle of tilt of a shelf such as 12 and 13 from horizontal may vary somewhat but experience has shown that this angle preferably should be between $3\frac{1}{2}$ degrees minimum tilt to a maximum tilt of approximately 8 degrees. The angle of tilt for most applications of the invention should be approximately 6 degrees from horizontal.

Should a row of bottles be allowed for any reason to rest within the confines of a particular chute which is not bowed according to this invention for an extended period of time, it is possible that the bottles may tend to remain in a given position so that removal of the front bottle in a row does not result in immediate downward movement of the remaining bottles. In order to preclude this result and in accordance with one feature of this invention, the chutes C are formed in such manner that they are bowed upwardly as is represented in FIG. 5. In FIG. 5 the ends of the chute are shown resting on the support surfaces 21 and 25 while the mid-portion of the chute C is shown in spaced relation to the support surface 23. This spacing preferably should be approximately $\frac{1}{4}$ inch for a chute which is from 21 to 24 inches in length. Of course FIG. 5 represents the unloaded condition of chute C. When bottles are placed on chute C, the upwardly bowed unloaded chute straightens and its mid-portion moves into contact with the intermediate support surface 23. With the chute then loaded with bottles and in staightened condition with its mid-portion in contact with the intermediate support surface 23, an inherent upward bias is established in the chute C so that when the front bottle is removed an upward movement takes place which tends to jostle the remaining bottles and thus overcomes any static friction and promptly initiates downward movement of the bottles toward the forward strut 17.

INDUSTRIAL APPLICABILITY

The invention is particularly well adapted for use in connection with shelves constituting components of display stands used in retail outlets and is particularly desirable because by the invention a simplified mechanically strong and economical gravity feed shelf is provided.

I claim:

1. A gravity feed shelf comprising a substantially rigid support frame which is forwardly and downwardly inclined, front and rear support surfaces formed on the front and rear portions of said frame respectively, an intermediate support surface forming a part of said frame and disposed between said front and rear support surfaces and in substantial coincidence with an imaginary straight line interconnecting said front and rear support surfaces, an elongated chute mounted on said support frame with its ends in contact with said front and rear support surfaces so that a row of articles disposed on said chute is automatically fed in the direction of inclination of said support frame upon removal of the leading article in the row, said chute being formed of semi-rigid yieldable material and being upwardly bowed somewhat in the absence of said row of articles and being substantially flat and with a part intermediate its ends in contact with said intermediate support surface when loaded.

2. A shelf according to claim 1 wherein said chute is formed of polyvinyl chloride.

3. A shelf according to claim 1 wherein said chute is formed of high impact polystyrene impregnated with silicone.

4. A shelf according to claim 1 wherein said chute comprises a channel having a web panel and a pair of flange panels integrally formed along the edges of said web panel.

5. A shelf according to claim 4 wherein a medial trough is formed in the upper surface of said web panel.

6. A shelf according to claim 5 wherein a plurality of ribs are formed in the upper surface of said web panel on each side of said trough.

7. A shelf according to claim 4 wherein a pair of guide strips are secured to the inner surfaces of said flange panels remote from said web panel.

8. A shelf according to claim 1 wherein said chute is secured to one of said support surfaces.

9. A shelf according to claim 1 wherein said chute is secured to said front support surface.

10. A shelf according to claim 1 wherein a plurality of elongated chutes are mounted on said frame in side by side relation so as to accommodate a plurality of rows of articles respectively.

11. In a gravity feed shelf assembly, an extruded chute comprising a web panel, a pair of flange panels integral with the side edges of said web panel and forming therewith a substantially channel shaped structure, a plurality of substantially parallel ribs of substantially triangular cross-sectional configuration and formed on said web panel and between said flange panels, a pair of guide strips formed integrally with said flange panels along the inner surfaces thereof and remote from said web panel, and a medial trough formed in said web panel and between said flange panels, said chute being of an upwardly bowed configuration.

12. A chute according to claim 11 formed of polyvinyl chloride.

13. A chute according to claim 11 formed of high impact polystyrene impregnated with silicone.

14. A chute according to claim 11 wherein said chute is approximately 21–24 inches in length and the midportion thereof is spaced approximately $\frac{1}{4}$ from an imaginary line intersecting the ends of said chute and extending therebetween.

* * * * *